United States Patent [19]

Ishii et al.

[11] 4,445,981

[45] May 1, 1984

[54] METHOD OF FORMING COLORED PATTERN ON THE SURFACE OF ALUMINUM OR ALUMINUM ALLOY

[75] Inventors: Tetsuro Ishii; Tadanori Oyama; Masashi Yamashita; Kazuyuki Kzome; Tsutomu Ikeda; Satoru Fujioka, all of Kagawa, Japan

[73] Assignee: Nihon Koki Kabushiki Kaisha, Kagawa, Japan

[21] Appl. No.: 445,633

[22] Filed: Nov. 30, 1982

[30] Foreign Application Priority Data

May 20, 1982 [JP] Japan ..... 57-87028

[51] Int. Cl.[3] ..... C25D 5/02; C25D 5/34

[52] U.S. Cl. ..... 204/18.1; 204/23; 204/35 N

[58] Field of Search ..... 204/18.1, 23, 35 N

[56] References Cited

U.S. PATENT DOCUMENTS

| | | | |
|---|---|---|---|
| 2,421,735 | 6/1947 | Prest | 204/18.1 |
| 3,654,117 | 4/1972 | Klein | 204/18.1 |
| 3,775,263 | 11/1973 | Rjumshina | 204/18.1 |
| 4,066,516 | 1/1978 | Sato | 204/18.1 |

FOREIGN PATENT DOCUMENTS

| | | | |
|---|---|---|---|
| 55-181037 | 12/1980 | Japan | 204/18.1 |
| 55-182310 | 12/1980 | Japan | 204/18.1 |
| 56-033002 | 3/1981 | Japan | 204/18.1 |
| 56-069989 | 5/1981 | Japan | 204/18.1 |
| 56-069990 | 5/1981 | Japan | 204/18.1 |

*Primary Examiner*—T. Tufariello

*Attorney, Agent, or Firm*—Millen & White

[57] ABSTRACT

A method of forming a colored pattern on the surface of aluminum or aluminum alloy comprising the steps of subjecting the surface to a first electrolytic treatment to form a background of anodic oxide film, and placing a pattern-forming electrode against the surface in adjacent but spaced apart relation. The surface is then subjected to a second electrolytic treatment to electrochemically impress the pattern onto the background by applying a voltage between the surface and the pattern-forming electrode in an electrolytic bath containing a metallic salt. The pattern-forming electrode is removed from the surface, and the surface having the background and the pattern is subjected to a third electrolytic treatment in an electrolytic bath containing a metallic salt to develop difference in color tones and intensities between the background and the pattern.

9 Claims, 13 Drawing Figures

METHOD OF FORMING COLORED PATTERN ON THE SURFACE OF ALUMINUM OR ALUMINUM ALLOY

FIELD OF THE ART

The present invention relates to a method of electrochemically forming a colored pattern on the surface of aluminum or an alloy thereof (hereinafter referred to as aluminum material).

SUMMARY OF THE INVENTION

An object of the invention is to form a colored pattern on the surface of an aluminum material by an electrolytic coloring method.

The method according to the present invention comprises the steps of subjecting the surface of an aluminum material to a first electrolytic treatment to form a background of anodic oxide film, placing a pattern-forming electrode against the surface in adjacent but spaced apart relation, subjecting the surface to a second electrolytic treatment to electrochemically impress the pattern onto the background by applying a voltage between the surface and the pattern-forming electrode in an electrolytic bath containing a metallic salt, removing the pattern-forming electrode from the surface, and subjecting the surface, having said background and said pattern, to a third electrolytic treatment in an electrolytic bath containing a metallic salt to develop difference in color tones and intensities between the background and the pattern.

DESCRIPTION OF THE PREFERRED EMBODIMENTS

Figure 1:
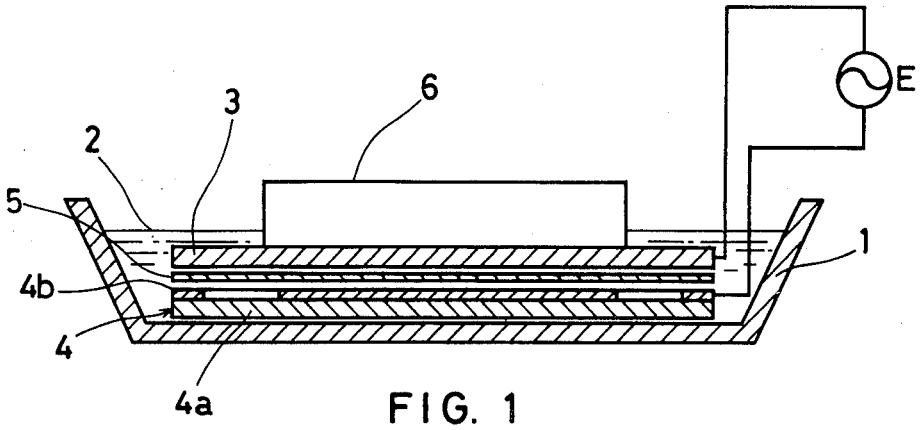
FIG. 1 is an explanatory view of a device used in the second electrolytic treatment of the method of the present invention.

The second electrolytic treatment in the present invention will be described with reference to devices shown by way of example in the drawings. In FIG. 1, the numeral 1 denotes an electrolytic cell; 2 denotes an electrolytic solution; 3 denotes an aluminum material having a background of anodic oxide film formed by the first electrolytic treatment; 4 denotes a pattern-forming electrode; 5 denotes a liquid-permeable film insulator, e.g., a 0.1 mm thick silk cloth, interposed between the aluminum material 3 and the pattern-forming electrode 4; and 6 denotes a weight placed on the aluminum material 3.

In this device, when an AC voltage is applied between the aluminum material 3 and the pattern forming electrode 4, a colored pattern corresponding to the energized area of the electrode 3 will be formed on the background surface of the aluminum material 3.

Figure 2:
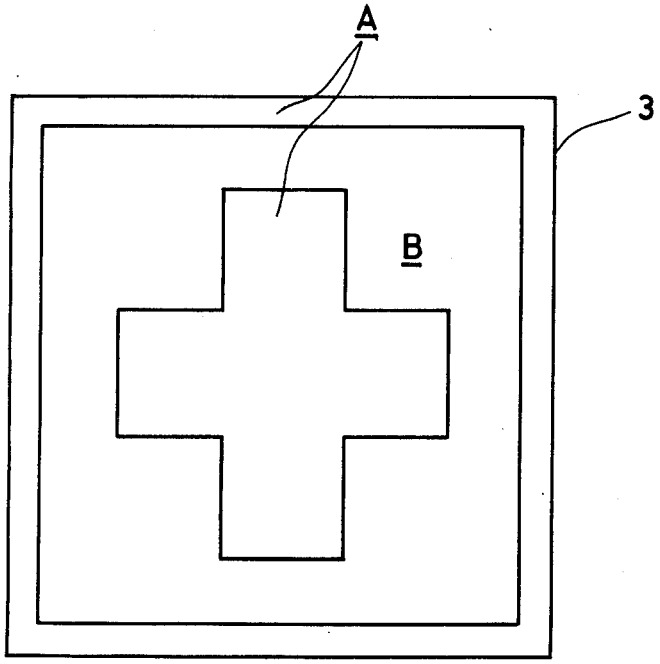
FIG. 2 is a plan view of an aluminum material treated in the device of FIG. 1.

In FIG. 2, the character A denotes a pattern formed on the background surface by the second electrolytic treatment, and B denotes the background.

Thus, in the present invention, the first requirement for the second electrolytic treatment is to apply a voltage between the aluminum material 3 and the pattern-forming electrode 4 while pressing former against the latter, whereby the pattern corresponding to the energized area of the pattern-forming electrode 4 can be sharply reproduced on the aluminum material 3.

In this case, the insulator 5 between the aluminum material 3 and the pattern-forming electrode 4 is preferably thin (suitably 0.1–0.3 mm thick), provided that insulation between them is not broken down, and it will sometimes be omitted if not needed. The pressing force provided by the weight 6 should be increased within the range in which insulation breakdown does not occur, since a greater force will produce a sharper pattern on the aluminum material 3.

The basic principle enabling coloration by this method is that fine inorganic particles electrochemically deposited on the bottoms of the minute holes in the anodized layer in the energized area scatter and absorb light, causing the layer to look colored. On the other hand, deposit of inorganic particles does not occur in the unenergized area, so that no coloration takes place. Although the amount of liquid present between the pattern-forming electrode and the aluminum substrate is very small (1 cc/dm$^2$), even a trace amount of deposited inorganic particles will provide sufficiently intense coloration. This is the most important technical finding in attaining the present invention. Thus, this finding has led the present invention to the technical concept of placing the pattern-forming electrode and the aluminum substrate close to each other.

The pattern-forming electrode 4 refers to an electrode having a varying electric resistance distribution corresponding to the pattern to be impressed. With said electrode 4 and the aluminum material 3 placed close to each other, DC or AC electrolysis is performed, whereby a pattern corresponding to the intensity distribution of the current flowing through the two is formed on the aluminum material 3.

Some examples of the pattern-forming electrode 4 will now be described with reference to the drawings.

1. This pattern-forming electrode 4, as shown in FIG. 1, is formed by nickel-plating a copper foil 4*b* having an etched pattern and placed on a substrate 4*a*; the surface are presented by the copper foil 4*b* will be energized, while the surface area having no copper foil 4*b* will not be energized. Thus, the pattern corresponding to the copper foil 4*b* will be reproduced on the surface of the aluminum material 3.

Figure 3:
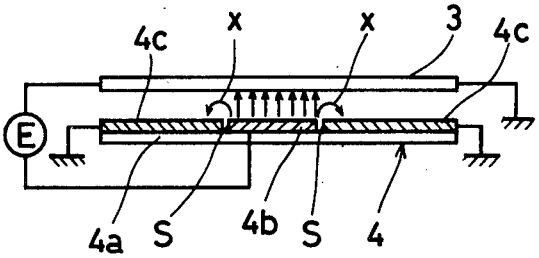
FIGS. 3, 5, 7 and 9 are explanatory view of devices similar to the device of FIG. 1.
Figure 4:
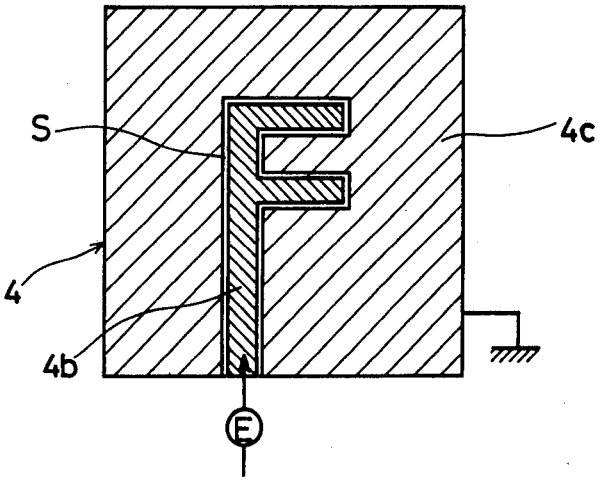
FIG. 4 is a plan view of the pattern-forming electrode used in the device of FIG. 3.

2. This pattern-forming electrode 4, as shown in FIG. 3 and 4, comprises a substrate 4*a*, a pattern-forming copper foil 4*b* placed on said print substrate, and a guard electrode 4*c* electrically insulated from and surrounding said copper foil with some clearance S therebetween, said guard electrode 4*c* being grounded. When this pattern-forming electrode 4 is used, the leakage electric field x produced around the copper foil 4*b* is absorbed by the guard electrode 4*c*, so that the reproduced pattern gives a neat design impression free from peripheral and interference fringes.

Figure 5:
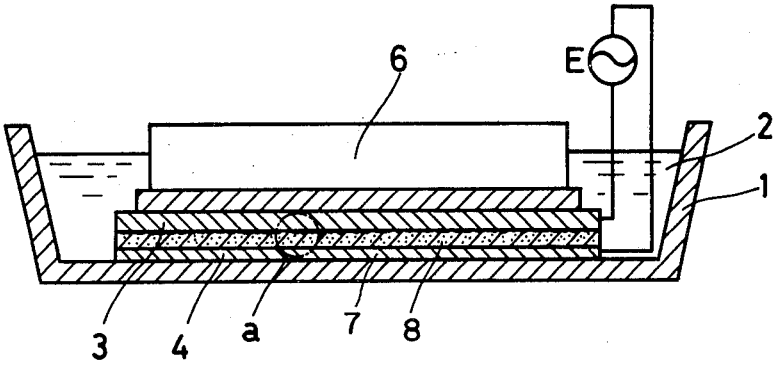
Figure 6:
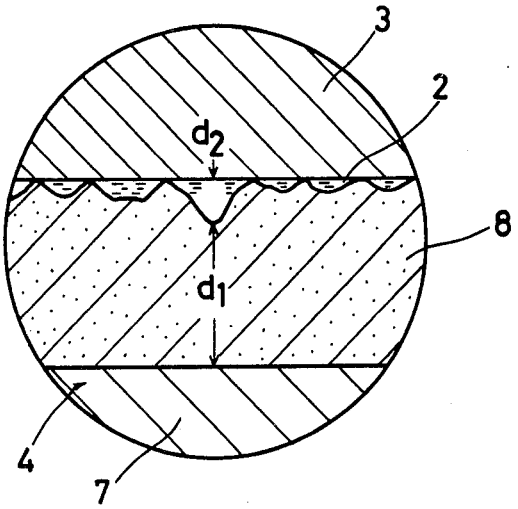
FIG. 6 is an enlarged view of a portion a of FIG. 5.

3. This pattern-forming electrode 4, as shown in FIGS. 5 and 6, comprises a plane electrode 7 made of stainless steel or the like, and an intermediate medium 8 made of balsa wood or the like placed on said plane electrode 7 and having an undulating pattern.

The intermediate medium 8 should meet the following conditions.

(1) The medium itself is an electric insulator.

(2) It is made of a porous material having liquid permeability, allowing the electrolytic solution to permeate the material.

(3) It is capable of being formed into a thin sheet and has an undulating pattern or is capable of having such pattern cut therein.

(4) It has some elasticity and is relatively resistant to compression.

(5) It has sufficient durability to withstand repeated use.

In this case, since the intermediate medium 8, which is a component of the pattern-forming electrode 4, is an electric insulator, the liquid-permeable sheet insulator is not necessary.

In the device of FIG. 5, when a voltage (AC in FIG. 5) is applied between the aluminum material 3 and the pattern-forming electrode 4, the undulating pattern of the intermediate medium 8 is reproduced on the surface of the aluminum material 3. That is, the presence of the intermediate medium 8 between the aluminum material 3 and the electrode plate 7 provides easily and hardly energizable regions, i.e., regions of different electric resistance values. In this example, as shown in FIG. 6, differences in the depth $d_2$ of the electrolytic solution entering the valleys of the surface of the intermediate medium 8 dominate the magnitude of electric resistance; the depth $d_2$ of the electrolytic solution is more dominant than the thickness $d_1$ of the intermediate medium 8. Thus, the deeper the valleys, i.e., the greater the depth $d_2$ of the electrolytic solution, the higher the electric resistance.

This arrangement provides the surface of the aluminum material 3 with a reproduction consisting of a light-colored area corresponding to the valleys and a dark-colored area corresponding to the hills of the undulating pattern formed on the intermediate medium 8.

In this example, since the application of voltage depends on the depth of the valleys of the surface of the intermediate medium 8, it is possible to apply a continuous pattern of voltage to produce a pattern having a delicate gradation or color tone. Therefore, according to this example, it is possible to sharply reproduce not only artificial patterns but also natural patterns such as a pattern of wood grain.

4. This pattern-forming electrode 4, as shown in FIGS. 7 and 8, is in the form of a metal plate 9 having an insulation film pattern 10 provided on the surface thereof, e.g., a photosensitive printed circuit board exposed and developed and then nickel-plated, leaving the photoresist layer unremoved.

Figure 7:
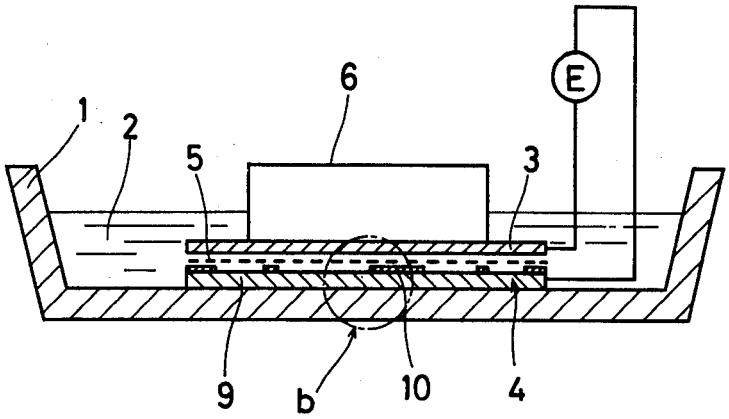
Figure 8:
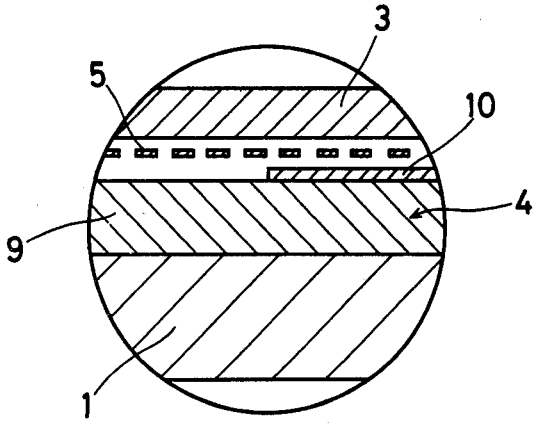
FIG. 8 is an enlarged view of a portion b of FIG. 7.

In the device of FIG. 7, when a voltage is applied between the aluminum material 3 and the pattern-forming electrode 4, the area corresponding to the insulation film pattern 10 will be the background area B and the area corresponding to the other area will be the patterned area A. That is, a pattern having an uncolored background area B will appear on the surface of the aluminum material 3.

Figure 9:
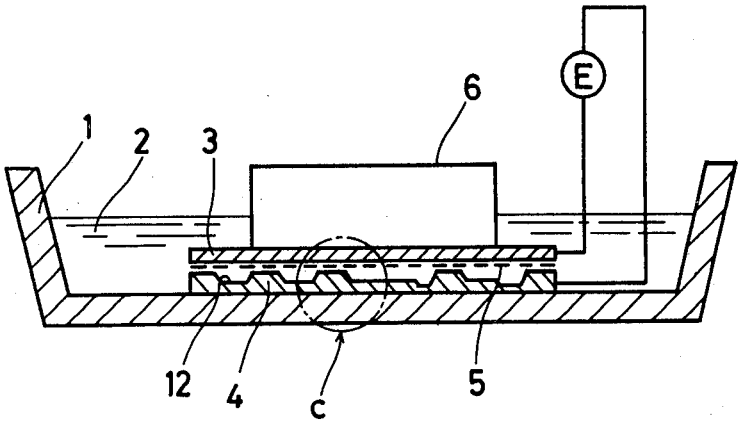
Figure 10:
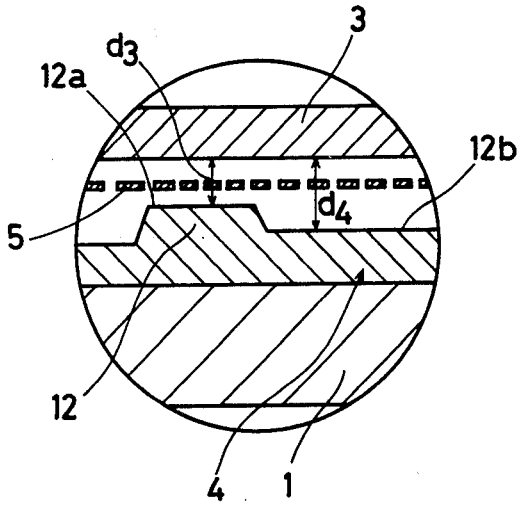
FIG. 10 is an enlarged view of a portion c of FIG. 9.

5. This pattern-forming electrode 4, as shown in FIGS. 9 and 10, is in the form of a metal electrode plate having an undulating surface pattern, e.g., a relief printing plate of zinc which is nickel-plated. The depth of the valleys of the undulating surface pattern 12 is preferably about 1.5 mm at a maximum.

In the device of FIG. 9, when a voltage is applied between the aluminum material 3 and the pattern-forming electrode 4, the undulating surface pattern 12 of the electrode 4 is reproduced on the surface of the aluminum material 3. That is, the difference between the depths $d_3$ and $d_4$ of the electrolytic solution layer present at the hills **12*a* and valleys 12*b* of the undulating surface pattern 12 between the aluminum material 3 and the electrode 4 produces a difference in electric conductivity such that the hills 12*a* are more electrically conductive than the valleys 12*b* (see FIG. 10**).

As a result, a pattern consisting of a light-colored area corresponding to the valleys and a dark-colored area corresponding to the hills is formed on the surface of the aluminum material 3.

In this example, since the way a voltage is applied depends on the thickness of the electrolytic solution present between the aluminum material 3 and the pattern-forming electrode 4, as described above, it is possible to apply a continuous pattern of voltage and produce a halftone pattern by controlling the manner of application of voltage.

According to the present invention, the color tones of the colored pattern area and uncolored background area on the aluminum material 3 formed in the second electrolytic stage can be changed in such a manner as to provide a desired shade difference by applying third electrolytic treatment, under proper energization control, to the aluminum material 3 which has undergone said second electrolytic treatment (basic process).

Figure 11:
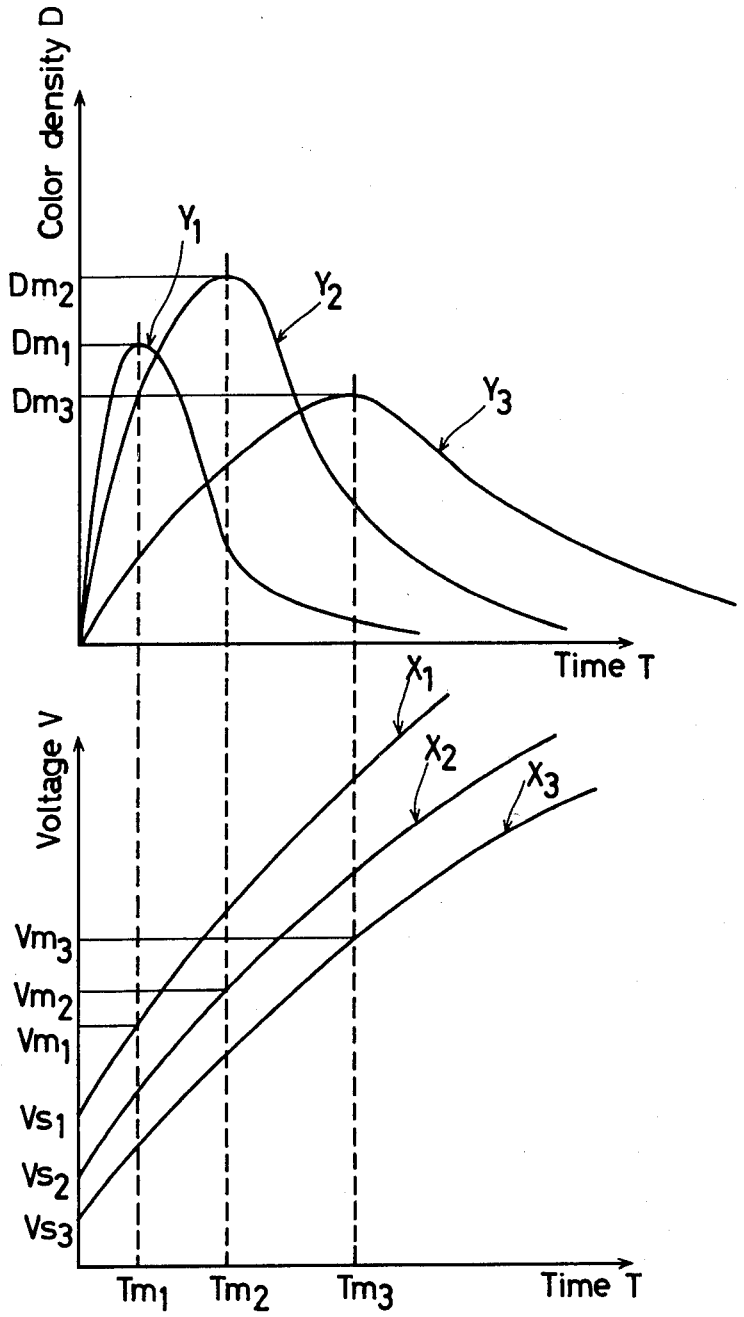
FIG. 11 is graphs showing the relation between energization time, color density and voltage in the case of electrolytic coloration using AC voltage.

FIG. 11 is graphs showing the relation between time T, color density D and applied voltage V in the case of applying an electrolytic coloration treatment using AC voltage to an aluminum material having an anodic oxide background.

As shown in FIG. 11, a voltage is applied to the aluminum material along voltage curves $X_1$, $X_2$and $X_3$, the color density D increases with time initially along coloration curves $Y_1$, $Y_2$ and $Y_3$ until points of time $Tm_1$, $Tm_2$ and $Tm_3$ are reached, whereupon it begins to decrease. Concerning the reason for this phenomenon, we think as follows.

The anodic oxide film formed on the surface of the aluminum material 3 has a rectifying action and a current flows mainly in one direction through the aluminum material 3 until the applied voltage reaches a constant value (peak inverse voltage) whereby inorganic particles will deposit to provide coloration, whereas when the applied voltage exceeds the peak inverse voltage, current flows in both directions through the aluminum material 3, acting to redissolve the inorganic particles. If this redissolving rate exceeds the precipitation rate of inorganic particles, decoloration is started; the characters $Vm_1$, $Vm_2$ and $Vm_3$ in FIG. 11 indicate the voltage at which decoloration is started (hereinafter referred to as decoloration voltage).

The manner in which the color tones of the pattern area A and background area B formed on the aluminum material 3 are changed in the invention will now be described with reference to the following two methods.

Figure 12:
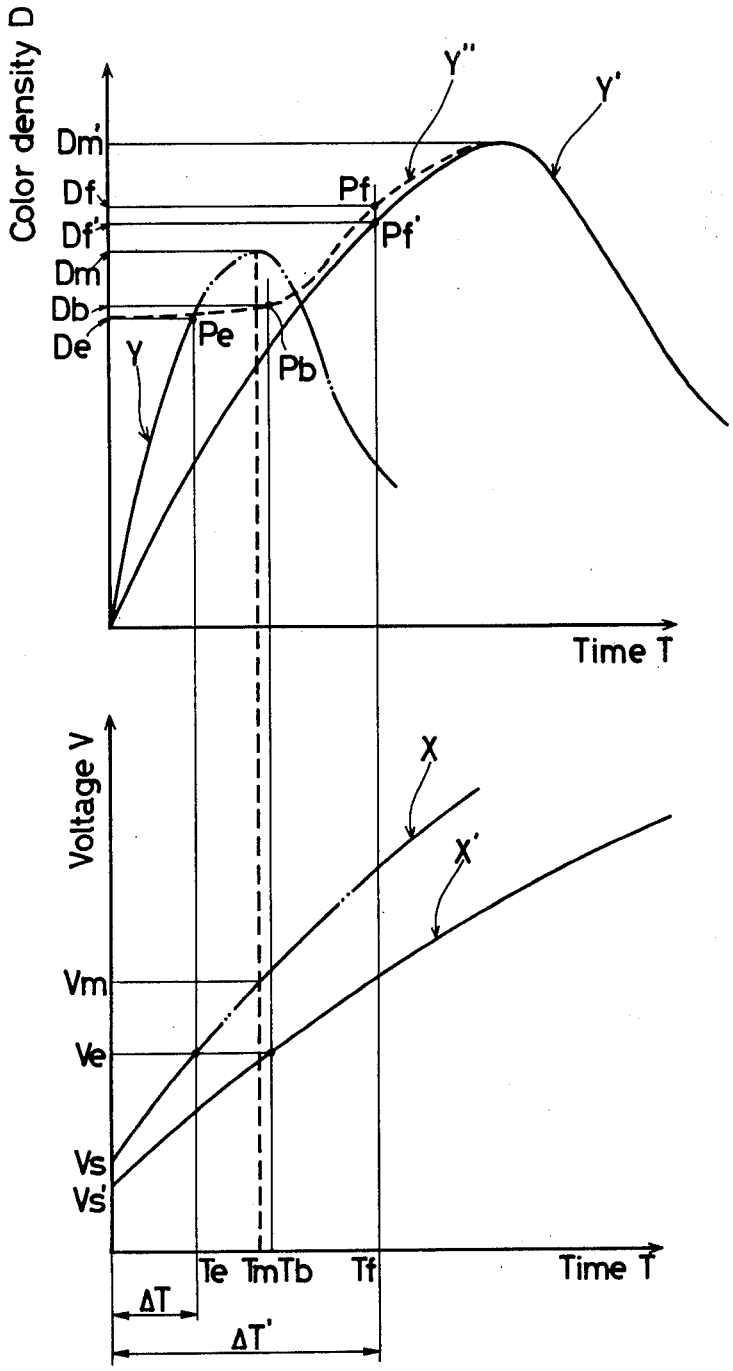
FIGS. 12 and 13 are graphs for explaining how the color density is changed by the second and third electrolytic treatment stages performed by the method of the invention.

Method 1 (see FIG. 12)

In this example, the application of voltage in the second electrolysis stage is effected along a voltage curve X monotonically increasing from Vs to Ve and the second electrolysis is terminated at voltage Ve (at time Te) before the decoloration voltage Vm in the second electrolysis is reached. This voltage Ve at the end of second electrolysis will be hereinafter referred to as terminal voltage.

As a result of this operation, the aluminum material 3 is formed with a pattern area A colored (at point Pe) to the color density De along a coloration curve Y and a background area B which is not colored.

Upon completion of this second electrolytic process, the third electrolytic treatment is performed by applying a voltage to the aluminum material 3 along a voltage curve X'. In this case, the start voltage Vs' in the third electrolytic process is lower than the terminal voltage Ve in the second electrolytic process.

When the third electrolytic process is performed under these conditions, the background area B which was initially in the uncolored state is subjected to electrolytic decoloration proceeding along a coloration curve Y' in the third electrolytic process, while the pattern area A already colored to the color density De shows no change in coloration until the applied voltage reaches the terminal voltage Ve in the second electrolytic process (or until point Pb is reached), but from the time (Tb) when it reaches said terminal voltage, coloration proceeds to point Pf along a coloration curve Y" approximating to the coloration curve Y' in the third electrolytic process; thus, at the time of termination (Tf) of the third electrolysis, the pattern area A is colored to the color density Df as its coloration proceeds to point Pf, while the background area B is colored to the color density Df' as its coloration proceeds to point Pf'.

In this first example, the second and third electrolytic processes have been performed with voltage below the decoloration voltages (Vm, Vm'), and in such case there is obtained a color tone wherein the color density (Df, Df') of the pattern and background areas A and B approximate to each other.

Figure 13:
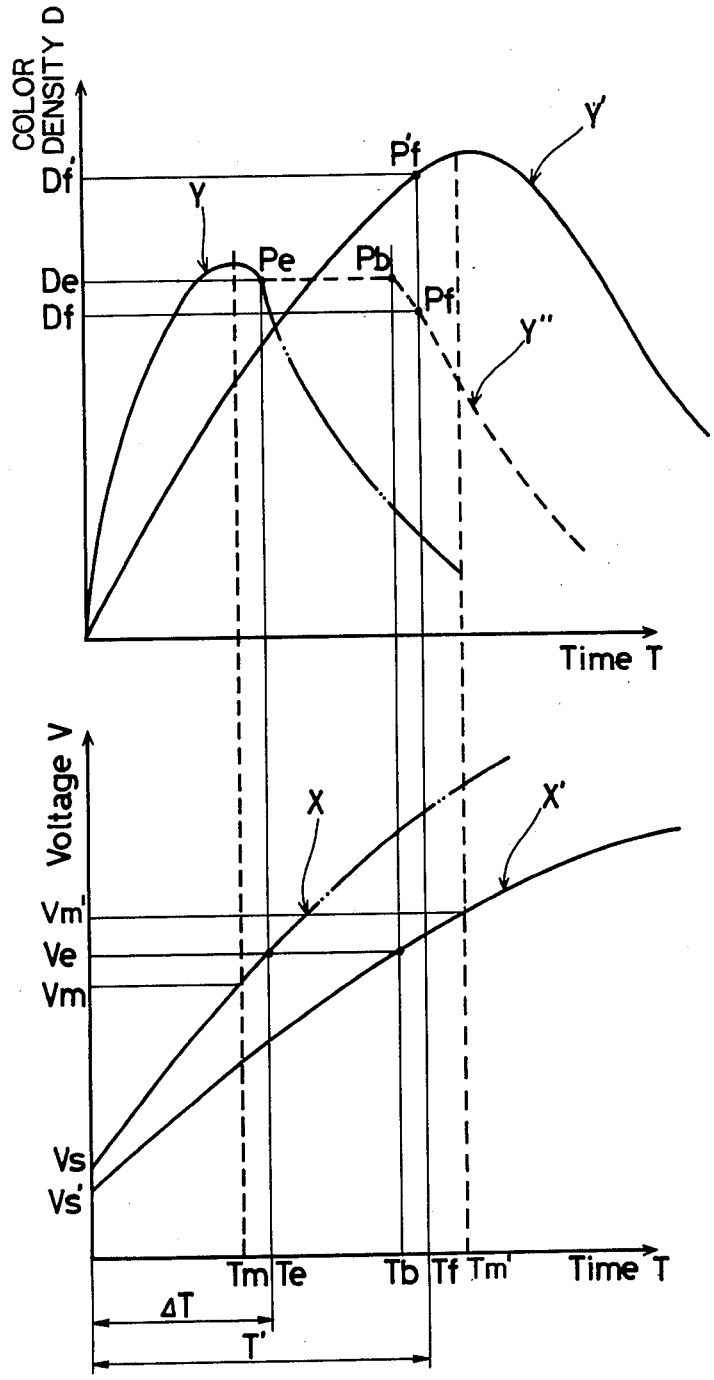

Method 2 (see FIG. 13)

In this example, the application of voltage is effected up to the terminal voltage Ve higher than the decoloration voltage Vm along the voltage curve X in the second electrolytic process, thereby subjecting the pattern area A to electrolytic coloration up to point Pe on the coloration curve Y. In this case, the pattern area A has already started decoloration (color density De).

Thereafter, a voltage is applied along the voltage curve X' in the third electrolytic process, whereby the background area B which was not colored in the second electrolytic process is colored along the coloration curve Y' while the pattern area A already colored to the color density De in the second electrolytic process starts to change in coloration (decolorize) from the time (Tb) when the applied voltage exceeds the terminal voltage Ve in the second electrolytic process, proceeding along the coloration curve Y" as shown at points Pe, Pb, Pf.

At the time of termination Tf, the background area B is at point Pf' on the coloration curve Y', colored to the color density Df', while the pattern area A is at the final color density Df because its decoloration has proceeded from point Pb to point Pf on the coloration curve Y".

That is, in this second example, the coloration intensities of the pattern and background areas A and B in the second electrolysis are reversed relative to each other.

In addition, the third electrolytic process in the present invention may be performed in an electrolytic cell different from the second electrolytic cell or in the latter with the pattern-forming electrode 4 spaced away from the aluminum material 3.

As described in the two examples above, according to the invention, the color tones of the pattern and background areas can be changed to provide a difference in shade as desired by subjecting the aluminum material, which has the pattern impressed by the second electrolytic treatment, to the third electrolytic treatment under suitable energizing conditions. As a result, ornamental aluminum materials having various color tones can be produced by a single pattern-forming electrode.

Examples of the present invention are listed below.

Example 1

Aluminum material used: A1050 aluminum plate

First electrolytic treatment (1) Electrolytic solution: Aqueous solution of 10 v/v% phosphoric acid (35° C.→42° C.)

(2) Counterelectrode: A1100 aluminum plate (3) Energizing conditions: 1 A/dm$^2$ ×40 minutes Second electrolytic treatment (1) Electrolytic solution: Aqueous solution (25° C.) containing 50 g/l of $NiSO_4.6H_2O$ and 50 g/l of $H_3BO_3$ (2) Pattern-forming electrode: Etched printed circuit board nickel-plated in a pattern forming fashion (3) Insulator: Silk cloth (4) Energizing conditions:

| Sample No. | Voltage | Energization time | Remarks |
|---|---|---|---|
| 1 | 0 → 20 V | 2 seconds | below peak inverse voltage |
| 2 | 0 → 30 V | 3 seconds | above peak inverse voltage |
| 3 | 0 → 40 V | 4 seconds | above peak inverse voltage |
| 4 | 0 → 50 V | 5 seconds | above peak inverse voltage |

*In addition, the application of voltage, in each case, is by soft start method.

Third electrolytic treatment (1) Electrolytic solution: Same as in second electrolytic treatment (2) Counterelectrode: Graphite plate (3) Energizing conditions:

For each of Sample Nos. 1 through 4; voltage 0→50 V, energization time=20 seconds, voltage above peak inverse voltage applied by soft start method.

Remarks

In each of Sample Nos. 1 through 4, the shades of color of the pattern and background areas were changed by the third electrolytic treatment such that the resulting difference in shade in each case differed from those in the other cases. In the case of Sample No. 1 where the final voltage in the second electrolytic treatment was below the peak inverse voltage, the shades of color of the pattern and background areas did not come to be reversed, but in the other samples, Nos. 2, 3 and 4, the pattern area was seen to decolorize in the third electrolytic treatment, with the results that the shades of color of the pattern and background area were seen to be reversed.

Example 2

Aluminum material used: A1050 aluminum plate
First electrolytic treatment
(1) Electrolytic solution: Aqueous solution of 10 v/v% phosphoric acid
(2) Opposed electrode: A1100 aluminum plate
(3) Energization conditions: 1 A/dm$^2$ ×40 minutes
Second electrolytic treatment
(1) Electrolytic solution: Aqueous solution (20° C.) of 50 g/l of nickel sulfate.6$H_2O$
(2) Pattern-forming electrode: Nickel-plated printed circuit board provided with guard electrode as FIG. 4 device.
(3) Insulator: Silk cloth
(4) Weight of weighting plate: 1 kg/dm$^2$
(5) Energization conditions: 10 A/dm$^2$ (pattern area) AC current was passed for 5 seconds When the electrolytic treatment was performed under the conditions mentioned above, a sharp pattern having no peripheral or interference fringes was observed on the surface of the aluminum plate.

Third electrolytic treatment
(1) Electrolytic solution: Same as in second electrolysis
(2) Counterelectrode: Graphite plate
(3) Energization conditions: Voltage 0→50 V×20 seconds, voltage above inverse voltage by soft start method When the electrolytic treatment was performed under the conditions mentioned above, the shades of color of the pattern and background areas resulting from the second electrolysis changed such that the respective resulting differences in shade differed from each other.

Example 3

Aluminum material used: A5052 aluminum plate
First electrolytic treatment
(1) Electrolytic solution: Aqueous solution (20° C.) of 10 v/v% phosphoric acid
(2) Current density: 1 A/dm$^2$ (DC)
(3) Cathode: Pure aluminum plate
(4) Energization time: 40 minutes An anodic oxide film was formed on the surface of the aluminum plate by performing the first electrolytic treatment under the above-mentioned conditions. Second electrolytic treatment
(1) Electrolytic solution: Aqueous solution containing 50 g/l of nickel sulfate 6$H_2O$ and 50 g/l of boric acid
(2) Energization conditions: 10 A/dm$^2$ AC current was passed for 1 second, followed by the passage of 1 A/dm$^2$ AC current for 30 seconds
(3) Intermediate medium: Balsa wood (1 mm thick) having no mark cut in the surface thereof, the wood grain as such being used as an undulating pattern (FIGS. 5, 6).
(4) Counterelectrode: Stainless steel plate (SUS 304)
(5) Weight: 10 kg/dm$^2$ When the second electrolytic treatment was performed under the above-mentioned conditions, the pattern of the wood grain of the balsa wood was reproduced on the surface of the aluminum material. More particularly, the area of the aluminum material corresponding to the valleys of the balsa wood surface was not colored, but the area corresponding to the hills was colored bronze. Despite the fact that the valleys and hills of the wood grain were very small in depth or height, the reproduced pattern obtained was extremely sharp.

Third electrolytic treatment
(1) Electrolytic solution: Aqueous solution containing 50 g/l of nickel sulfate 6$H_2O$ and 50 g/l of boric acid
(2) Energization conditions: 500 mA/dm$^2$ AC current was passed for 20 seconds
(3) Counterelectrode: Stainless steel plate (SUS 304)

When the third electrolytic treatment was performed under the above-mentioned conditions, the area which was not colored in said second electrolytic treatment was colored bluish bronze, and the other area was colored darker bronze; thus, there was obtained a reproduced pattern having not only a difference in shade but also a difference in color tone.

Example 4

Aluminum material used: A5052 aluminum plate
First electrolytic treatment
(1) Electrolytic solution: Aqueous solution (20° C.) of 10 v/v% phosphoric acid
(2) Current density: 1 A/dm$^2$ (DC)
(3) Cathode: A1100 aluminum plate
(4) Energization time: 40 minutes An anodic oxide film was formed on the surface of the A5052 aluminum plate by performing the first electrolytic treatment under the above-mentioned conditions. Second electrolytic treatment
(1) Electrolytic solution: Aqueous solution (20° C.) of 50 g/l of nickel sulfate hexahydrate
(2) Pattern-forming electrode: Photosensitive printed circuit board exposed and developed and then nickel-plated, leaving photoresist layer unremoved providing an insulation film pattern (FIGS. 7, 8)
(3) Electric insulator: Silk cloth for silk screen purposes
(4) Weight: 0.5 kg/dm$^2$
(5) Energization conditions: 2 A/dm$^2$ (energized area) AC current was passed for 3 seconds When the second electrolytic treatment was performed under the above-mentioned conditions, the insulation film pattern on the pattern-forming electrode was reproduced on the surface of the aluminum material. More particularly, the area corresponding to the insulation film pattern was not colored and the other area colored bronze.

Third electrolytic treatment
(1) Electrolytic solution: Aqueous solution (20° C.) of 50 g/l of nickel sulfate 6$H_2O$
(2) Energization conditions: 0.3 A/dm$^2$ AC current was passed for 30 seconds
(3) Counterelectrode plate: Graphite plate When the third electrolytic treatment was performed under the above-mentioned conditions, the light and dark pattern obtained by said second electrolytic treatment changed to a pattern having a difference in color tone.

Example 5

Aluminum material used: A5052 aluminum plate
First electrolytic treatment
(1) Electrolytic solution: Aqueous solution (20° C.) of 10 v/v% phosphoric acid
(2) Current density: 1 A/dm$^2$ (DC)

(3) Cathode: A1100 aluminum plate
(4) Energization time: 40 minutes

An anodic oxide film was formed on the surface of the A5052 aluminum plate by performing the first electrolytic (anodizing) treatment under the above-mentioned conditions.

Second electrolytic treatment (1) Electrolytic solution: Aqueous solution (20° C.) of 50 g/l of nickel sulfate $6H_2O$
(2) Pattern-forming electrode: Relief printing plate of zinc having an undulating surface pattern, nickel-plated (FIGS. 9, 10)
(3) Electric insulator: Silk cloth for silk printing purposes
(4) Weight: 0.5 kg/dm$^2$
(5) Energization conditions: 10 A/dm$^2$ the AC current was passed for 5 seconds When the second electrolytic treatment was performed under the above-mentioned conditions, the undulating surface pattern on the pattern-forming electrode was reproduced on the surface of the aluminum material. More particularly, the area of the aluminum material corresponding to the valleys of the undulating surface pattern was colored light bronze and the area corresponding to the hills was colored dark bronze.

Third electrolytic treatment (1) Electrolytic solution: Aqueous solution (20° C.) of 50 g/l of nickel sulfate
(2) Energization conditions: 500 mA/dm$^2$ AC current was passed for 20 seconds
(3) Counterelectrode: Stainless steel plate (SUS 304)

When the third electrolytic treatment was performed under the above-mentioned conditions, the area colored light by said secondary electrolytic treatment was colored bluish bronze and the dark-colored area was colored dark bronze, thus providing a reproduced pattern having not only a difference in shade but also a difference in color tone.

What is claimed is:

1. A method of forming a colored pattern on the surface of aluminum or aluminum alloy comprising the steps of: subjecting said surface to a first electrolytic treatment to form a background of anodic oxide film; placing a pattern-forming electrode against said surface in adjacent but spaced apart relation, and subjecting said surface to a second electrolytic treatment to electrochemically impress said pattern onto said background by applying a voltage between said surface and said pattern-forming electrode in an electrolytic bath containing a metallic salt, said bath containing a metallic salt being capable of electrochemically depositing color-forming particles such that said color-forming particles are deposited by said second electrolytic treatment; removing said pattern-forming electrode from said surface; and subjecting said surface having said background and said pattern to a third electrolytic treatment in an electrolytic bath containing a metallic salt also capable of electrochemically depositing colorforming particles thereby developing differences in color tones and intensities between said background and said pattern.

2. A method as set forth in claim 1, wherein a thin porous insulation sheet is interposed between said surface and said pattern-forming electrode during said second electrolytic treatment.

3. A method as set forth in claim 1, wherein said pattern-forming electrode is a locally etched printed circuit boards.

4. A method as set forth in claim 2, wherein the insulation sheet is a mesh screen made of an insulating material.

5. A method as set forth in claim 1, wherein said pattern-forming electrode is a metal plate having a patterned profile.

6. A method as set forth in claim 1, wherein said second and third electrolytic treatment stages are carried out in the same electrolytic cell.

7. A method as set forth in claim 1, wherein said pattern-forming electrode comprises a conductive metal plate covered by an intermediate medium made of a porous insulating sheet having a patterned profile on the side facing said surface.

8. A method as set forth in claim 7, wherein said intermediate medium is made of natural wood.

9. A method as set forth in claim 1, wherein said pattern-forming electrode is a metal plate having an insulating film pattern provided on the surface thereof.

* * * * *